United States Patent [19]

Allen et al.

[11] Patent Number: 4,963,298

[45] Date of Patent: Oct. 16, 1990

[54] PROCESS FOR PREPARING FIBER, ROVINGS AND MATS FROM LYOTROPIC LIQUID CRYSTALLINE POLYMERS

[75] Inventors: Steven R. Allen; Aziz A. Mian, both of Wilmington; Sam L. Samuels, Claymont, all of Del.

[73] Assignee: E. I. Du Pont de Nemours and Company, Wilmington, Del.

[21] Appl. No.: 304,461

[22] Filed: Feb. 1, 1989

[51] Int. Cl.[5] ..... D01D 5/11

[52] U.S. Cl. ..... 264/12; 264/14; 264/517; 264/518; 264/141; 264/178 F; 264/180; 264/181; 264/184; 264/200

[58] Field of Search ..... 264/12, 14, 141, 180, 264/181, 10, 140, 143, 517, 518, 178 F, 184, 200

[56] References Cited

U.S. PATENT DOCUMENTS

| | | | |
|---|---|---|---|
| 3,849,241 | 11/1974 | Butin et al. | 156/167 |
| 4,013,744 | 3/1977 | Kuerten et al. | 264/14 |
| 4,189,455 | 2/1980 | Raganato et al. | 264/140 |

FOREIGN PATENT DOCUMENTS 166830 4/1984 European Pat. Off. .

*Primary Examiner*—Hubert C. Lorin

[57] ABSTRACT

Process for preparing subdenier fiber and structures thereof from lyotropic liquid crystalline polymers comprising extruding a stream of the polymer into a chamber, introducing a pressurized gas into the chamber, directing the gas in the flow direction of and in surrounding contact with the stream within the chamber, passing both the gas and the stream into a zoner of lower pressure at a velocity sufficient to attenuate the stream and fragment it into fibers, and contacting the fragmented stream in the zone with a coagulating fluid.

11 Claims, 2 Drawing Sheets

PROCESS FOR PREPARING FIBER, ROVINGS AND MATS FROM LYOTROPIC LIQUID CRYSTALLINE POLYMERS

BACKGROUND OF THE INVENTION

Various methods have been disclosed in the art for preparing mats of discontinuous thermoplastic fibers by directing gas streams at molten polymer (see EP No. 166830 and U.S. No. 3,849,241) and collecting the fibers on a screen. It is also known to flash extrude a fibrillated polymeric structure and to shred it by directing a stream of fluid at the structure at the moment of its formation (see U.S. No. 4,189,455).

The present invention provides novel processes for preparing pulp-like fibers, rovings or non-woven mats from lyotropic liquid crystalline polymers. It also contemplates and includes novel structures of subdenier fibers having different cross-sections and lengths which are produced thereby.

SUMMARY OF THE INVENTION

Figure 1:
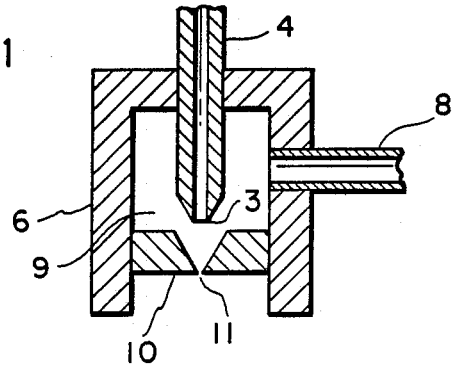
FIGS. 1-5 are cross-sectional schematic views of apparatus, primarily spin-cells, for practicing the invention.

This invention provides a process for preparing subdenier fibers from lyotropic liquid crystalline polymer. The process comprises (1) extruding a stream of an optically anisotropic solution of a polymer into a chamber, (2) introducing a pressurized gas into said chamber, (3) directing the gas in the flow direction of and in surrounding contact with said stream within the chamber, (4) passing both the gas and stream through an aperture into a zone of lower pressure at velocities sufficient to attenuate the stream and fragment it into fibers, and (5) contacting the fragmented stream in said zone with a coagulating fluid.

The fragmented stream of subdenier fibers may be collected in the form of pulp-like short fibers, rovings or mats and such products are contemplated as part of the present invention.

DETAILED DESCRIPTION OF THE INVENTION

Optically anisotropic solutions are useful in the present invention and are well known in the art. Such solutions include poly(p-phenylene terephthalamide) (PPD-T) in concentrated sulfuric acid as disclosed in U.S. Pat. Nos. 3,767,756 and 3,869,429 and cellulose triacetate in trifluoroacetic acid as disclosed in U.S. Pat. No. 4,464,326. If desired, polymers that do not form anisotropic solutions on their own, may be incorporated in the aforementioned anisotropic solutions before extrusion to form polymer blends or molecular composites of the polymers. Such added polymers include nylon 6/6, the amorphous polyamides prepared from a mixture of terephthalic acid, isophthalic acid, bis(p-aminocyclohexyl)methane and hexamethylene diamine and copolymers prepared from 3,4'-diaminodiphenyl ether, and isophthaloyl bis(caprol The solutions can be prepared by techniques understood by those skilled in the art.

The solution is extruded through a spinneret orifice into a chamber in the vicinity of an aperture, generally convergent-walled through which it will exit the chamber. A pressurized gas which is inert to the anisotropic solution, is introduced into the chamber also in the vicinity of the aperture and in surrounding contact with the solution stream. The gas, preferably air, is conveniently at a pressure between 3.0 kg/sq.cm. and 5.0 kg/sq.cm. and is at a temperature of from 20° C. to 120° C.- as it is fed into the chamber. The velocity of the gas is such as to attenuate and fragment the stream as it exits the chamber through the aperture.

The gas and stream upon leaving the chamber, enter a zone of lower pressure, preferably air at atmospheric pressure. It is in this zone that the fragmented stream is contacted either before or after collection, with a jet of coagulating fluid.

In order to prepare a mat, the fragmented stream is contacted with a jet of coagulating fluid, for example, water, at some distance such as 15 to 30 centimeters from the aperture. The water jet will coagulate and disperse the stream which may then be collected as a mat on a screen belt moving transversely to the dispersed stream. Where the stream comprises a sulfuric acid solution of PPD-T, contact with water dilutes the acid and causes the polymer to come out of solution The collected material may be washed further or neutralized with dilute base, as is known in the art while on the screen belt. The resulting mat is formed by the random laydown of jet attenuated spun, oriented, subdenier, discontinuous fibers having widely varying morphology. It may be tacked at fiber cross-over points to form a dimensionally stable sheet structure.

To make pulp-like product, coagulating fluid is caused to contact the exiting solution stream at the aperture. The pulp-like product consists of short oriented, subdenier fibers with varying cross-sectional morphology and lengths up to 15.0 mm.

Finally, to make roving or sliver, a jet of coagulating fluid is directed against the fragmented stream at a distance from the aperture of between about 1.0 and 10.0 cms. and the coagulated product is collected on a screen; however, in this case the jet employed is one that lacks sufficient force to disperse the coagulated product before it is collected. This structure is an essentially unidirectional lay down of oriented subdenier, discontinuous fibers having widely varying morphology with essentially no tacking or bonding between fibers.

A more detailed description of suitable apparatus and methods of operation appears below.

FIG. 1 shows, in schematic cross-section, a spin-cell having a tubular 1-hole spinneret (4) with an outlet (3) extending into chamber (9) of cylindrical manifold (6). The manifold has an inlet (8) and a nozzle (10) with a convergent-walled aperture (11) serving as an exit from the cell. In operation, an anisotropic solution of polymer is metered through spinneret (4) and into chamber (9) where it is contacted by a pressurized gas introduced from inlet (8). The gas attenuates and fractures the polymer solution into elongated fragments as it passes out of the chamber through aperture (11), whose walls converge into a narrower opening. As the stream of elongated fragments exit aperture (11) they are contacted with a coagulating fluid. A variety of products may be obtained depending upon how the contact is made.

Figure 2:
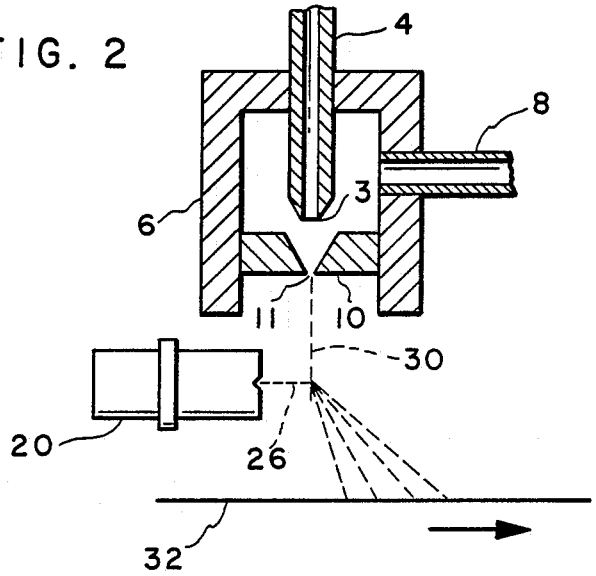

FIG. 2 shows a process wherein the elongated fragments or fibers exiting spin-cell (6) are contacted at a distance below aperture (11) with a fluid (26) from spray jet nozzles (20) which acts to coagulate and spread the fragments of stream (30) which are then deposited as a nonwoven sheet onto moving screen (32) If desired, a sequence of such jets may be employed. These fragments are subdenier fibers with widely different cross sections. They have lengths of up to 10 cm., diameters of up to 10 microns, and length to diameter ratios of at least 1000. The fibers on the screen can be washed, dried and wound onto a bobbin (not shown) all in a continuous process.

Figure 3:
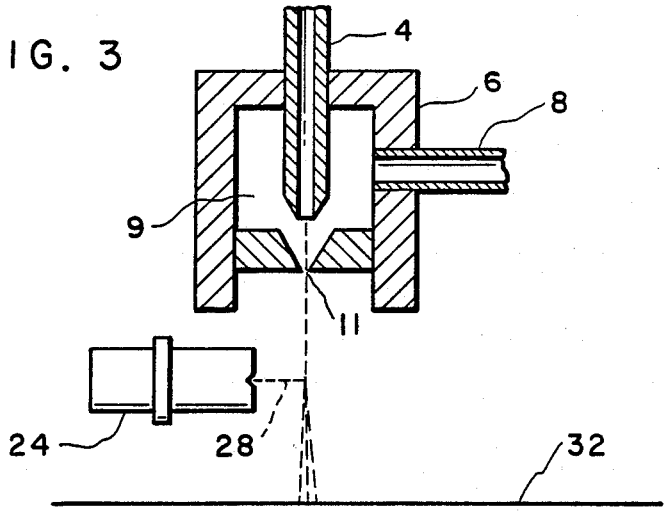

FIG. 3 shows an alternate method for contacting the stream leaving aperture (11) with coagulating fluid to produce roving or sliver. In this case, an atomized jet of coagulating fluid (28) from spray jet nozzle(s) (24) impinges on the stream exiting aperture (11) at a distance up to 10 cm below the aperture. The fibers in the stream have a momentum greater than the atomized jet of coagulating fluid and consequently deflection of the stream and dispersal of the fibers is low. Under these conditions the subsequent fiber deposition on the moving screen (32) is essentially unidirectional and the product is suitable for sliver or roving. In an analogous method, the stream exiting aperture (11) may be prevented from spreading by surrounding the stream with a curtain of coagulating fluid flowing in the same direction. The curtain of the coagulating fluid initiates fiber coagulation and prevents spreading.

In either case, the stream containing coagulated fibers is intercepted by a moving screen conveyor belt causing the fibers to lay down essentially unidirectionally over the screen. The sliver or roving which forms can be wrapped on a bobbin (not shown). The fibers are similar to those of the previously described nonwoven mat.

Figure 4:
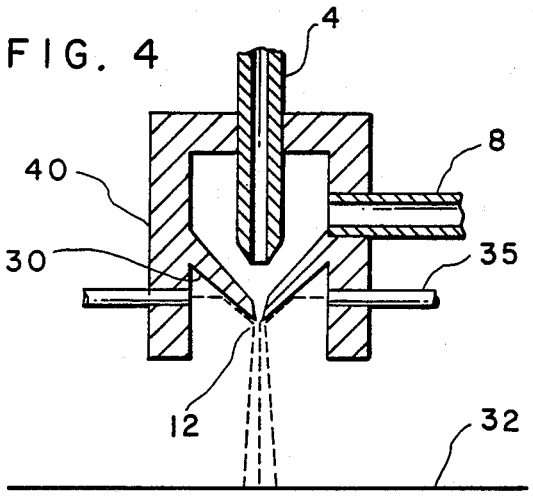

FIG. 4 shows a method for producing pulp-like short fibers. FIG. 4 shows spin-cell (40) which is similar to that of FIG. 1, except for having a conical nozzle (30) and a jet (35) which is built into the spin cell housing. Coagulating fluid from jet (35) is impinged on the outer surface of nozzle (30) and trickles down the slope of nozzle (30) to aperture (12) and contacts the exiting stream. This results in formation of a pulp-like short length coagulated fragments which can be spread over a screen conveyor belt or recovered in a receptacle (not shown) located below the spin-cell.

It will be obvious to one skilled in the art that a variety of modifications of the above apparatus may be made. Thus, if desired, a plurality of spin-cells arranged side-by-side in linear fashion may be employed to achieve laydown of uniform sheets of considerable width. Similarly, a diverging channel formed by walls aligned in parallel and positioned at the exit of aperture (11) will cause the exiting stream to spread into a wider stream as it leaves the spinning cells.

Figure 5:
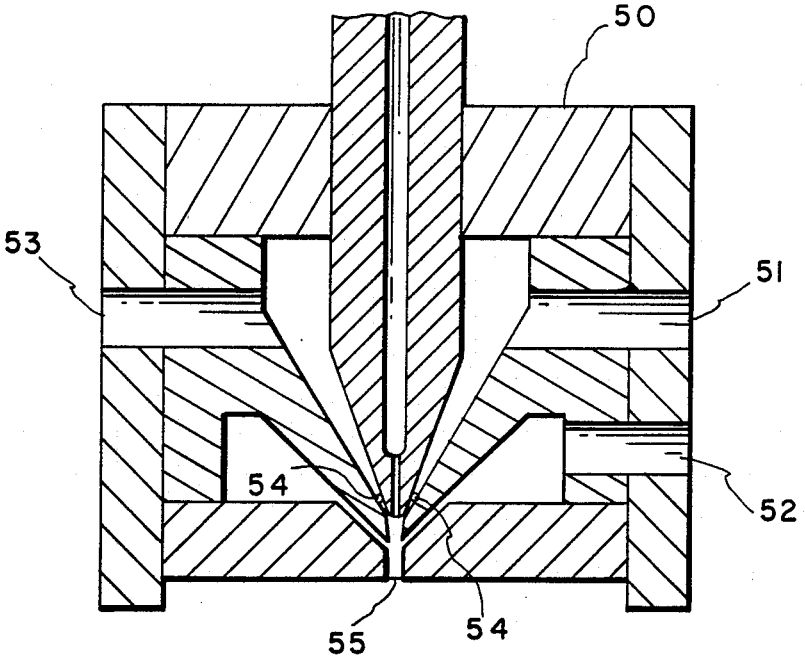

FIG. 5 shows a spin-cell (50) with inlet (51) for admitting hot air to heat the spinneret to prevent plugging while inlet (52) admits cold processing air to be introduced at the second stage. Seal (54) prevents the hot air from mixing with the cold air in the spin cell. Spent hot air may be removed from the chamber through exit (53). Polymer solution and cold air leave through exit aperture (55).

TESTING PROCEDURES

The fibers have very fine structure and irregular and varied cross-sections. Techniques for measuring the denier of non-round and varying diameter fibers are known and include Specific Surface Area Measurement, Scanning Electron Microscope Measurement and direct measurement of a sample group of fibers under the optical microscope.

Tensile measurements require knowledge of the denier. An Instron 1122 was employed for determination of tenacity and modulus following ASTM D2101 Section 10.6 (strain <10%). For 1.0 inch sample lengths, the clamp (grips with inch 6/16 inch ×6/16 inch neoprene faces) were set between 1−¼ and 1−½ inches apart and operated at a crosshead speed of 0.1 inch/min. while for 0.25 inch sample length, the clamps were set at 0.75 inch between faces and translated at a crosshead speed of 0.025 inch/min.

Each end of a filament sample was taped to opposite ends of a rectangular tab with a rectangular cut-out (opening) of the specified length (1 inch or 0.25 inch). Taping was at a distance away from the opening and some slack in the fiber was allowed. A drop of adhesive was placed close to the edges of the tab opening to bond the designated length of filament to correspond to length of the tab opening. The tab was mounted in the top clamp of the Instron after cutting one side of the tab. The opposite end of the tab was then mounted in the lower clamp and the other side of the tab was cut leaving the filament extended across the gap between the clamps. The Instron is turned on and the stress-strain relationship of the filament is directly fed into the computer which calculates the tensile properties.

The following examples are submitted as illustrative of the present invention and are not intended as limiting.

EXAMPLE 1

A 19.5% by weight solution of poly(p-phenyleneterephthalamide) (PPD-T) having an inherent viscosity of 6.15 dl/g in sulfuric acid was prepared by adding 19.5 parts by weight of the polymer in powder form into 80.5 parts by weight fuming sulfuric acid (conc. 100.3%) which had been pre-cooled to −20° C. During the addition of the polymer to the acid, the temperature was allowed to rise to 70° C. and held at the same temperature for one hour, followed by heating to 80° C. under vacuum for one hour to degas the solution. The solution (at 80° C.) was then pushed hydraulically into a spin-cell similar to that shown in FIG. 1 through a single-hole spinneret (dia.=0.003 in., 0.076 mm; L/D =2.0) according to the conditions shown in Table I. Referring to FIG. 1, the spin-cell had an air-gap of 0.125 in. (3.175 mm) as measured from the outlet (3) of the spinneret to the narrowest diameter of the aperture (11) of nozzle (10) of the spin-cell. The convergent wall of aperture (11) was at an angle of 45°. Heated (80° C.) and pressurized (3.25 kg/sq.cm.) air was supplied to the spin-cell to attenuate and fragment the freshly extruded polymer. The short fibers leaving the spin-cell were then contacted with a stream of water (25° C., 1 gallon per minute) having a 110° spread angle as supplied from a spray nozzle (Spraying Systems Co., Wheaton, Ill. Model H1/4VV 11010) to quench, coagulate and spread the fibers. The fibers were then collected in the form of a sheet onto a moving 60-mesh stainless steel screen, neutralized with a spray of aqueous NaOH (0.6% solution), and washed with water while on the moving screen. The mat or sheet (average basis weight of 6.5 g/m$^2$) was subsequently wound on a bobbin. Properties of the fibers are shown in Table II.

Although air was supplied in this example at a temperature about equal to the polymer stream temperature, it may be preferable to lower the air temperature at the exit of the spin-cell in order to accelerate fiber quenching and enhance fiber strength.

EXAMPLE 2

A 38% by weight solution of cellulose triacetate in aqueous trifluoroacetic acid (TFA) (100 parts by weight TFA/8 parts by weight $H_2O$) was prepared by adding 38 parts by weight cellulose triacetate (Kodak Chemicals, Rochester, NY) into 62 parts by weight solvent pre-cooled to −20° C.

After mixing the solution for 23 hours at −20 ° C., the polymer dope was brought to 25° C. and forced with a piston into a spin-cell similar to that shown in FIG. 1 through a one-hole spinneret (dia.=0.004 in., 0.102 mm; L/D=2.0) according to the conditions shown in Table III. Referring to FIG. 1, the spin-cell had an air gap of 0.125 in. (3.175 mm) as measured from the outlet (3) of the spinneret (4) to the narrowest diameter of aperture (11) of nozzle (10) of the spin-cell and a convergent angle of 45° for the aperture. Air (25° C., 5.25 kg/sq.cm.) was supplied to the spin cell to attenuate and fragment the freshly extruded polymer. The fibers leaving the spin-cell were then contacted with a stream of water (15° C., 1.0 gpm) supplied by a spray nozzle (Spraying System Co., Model #1/4 P5010) to quench and spread the fibers. The fibers were then collected in the form of a mat or sheet onto a moving 60-mesh stainless steel screen. The fibrous mat was neutralized with aqueous NaOH (0.6% solution), washed with water, and subsequently wound up. The average basis weight of the sheet was 21.7 g/m$^2$.

TABLE I

| | SPINNING CONDITIONS | | | |
|---|---|---|---|---|
| Run | Polymer soln. Jet Vel. (fpm)//m/min. | Air Press. (psig//kg/sq · cm | Air Temp. (°C.) | Air-Jet Nozzle dia. (in/mm) |
| 1 | 48.3//14.72 | 30//3.14 | 84 | 0.03/0.762 |
| 2 | 91.2//27.8 | 80//6.66 | 85 | 0.03/0.762 |
| 3 | 49.8//15.18 | 80//6.66 | 84 | 0.03/0.762 |
| 4 | 451.8//137.71 | 80//6.66 | 86 | 0.03/0.762 |
| 5 | 393.5//119.93 | 30//3.14 | 81 | 0.03/0.762 |
| 6 | 85.6//26.1 | 80//6.66 | 86 | 0.06/1.524 |
| 7 | 54.2/16.52 | 80//6.66 | 83 | 0.06/1.524 |

TABLE II

| | FIBER PROPERTIES | | | | |
|---|---|---|---|---|---|
| Run* | Denier (dpf) | Tenacity g/d | Modulus g/d | Average Number of Filaments | Specific/ Surf. Area sq · m/gm |
| 1 | 0.0385 | 25.100 | 649.8 | 6 | 1.090 |
| 2 | 0.0728 | 28.670 | 877.5 | 6 | 0.934 |
| 3 | 0.0700 | 34.520 | 531.2 | 6 | — |
| 4 | 0.0930 | 20.180 | 336.8 | 6 | — |
| 5 | 0.7040 | 4.430 | 112.1 | 10 | — |
| 6 | 0.0560 | 6.877 | 136.6 | 6 | — |
| 7 | 0.0386 | 25.690 | 500.5 | 5 | — |

*Corresponds to TABLE I

TABLE III

| SPINNING CONDITIONS FOR CELLULOSE TRIACETATE | | | |
|---|---|---|---|
| Run | Polymer soln. Jet Vel. (fpm)/(m/min) | Air Press. (psig/kg/sq · cm) | Airjet (in./mm) |
| 1 | 312/95.1 | 60/5.25 | 0.06/1.57 |
| 2 | 228.7/69.7 | 60/5.25 | 0.06/1.57 |
| 3 | 263.9/80.4 | 60/5.25 | 0.06/1.57 |
| 4 | 183.0/55.8 | 60/5.25 | 0.06/1.57 |
| 5 | 254.2/77.5 | 60/5.25 | 0.06/1.57 |

TABLE III-continued

| SPINNING CONDITIONS FOR CELLULOSE TRIACETATE | | | |
|---|---|---|---|
| Run | Polymer soln. Jet Vel. (fpm)/(m/min) | Air Press. (psig/kg/sq · cm) | Airjet (in./mm) |
| 6 | 1055.7–254.2/ 321.8–77.5 | 60/5.25 | 0.06/1.57 |
| 7 | 1055.7/321.8 | 60/5.25 | 0.06/1.57 |

EXAMPLE 3

Highly attenuated pulp-like short fibers with lengths varying between 1 and 15 mm were prepared continuously using a sulfuric acid solution of PPD-T. Air was used as the attenuating fluid, and water as the coagulating fluid. The exit aperture was open to the atmosphere and water was impinged on the outer surface of the air-jet nozzle.

A 19.0% solids solution of poly(p-phenyleneterephthalamide) in concentrated sulfuric acid (100.3%) was fed at a rate of 5.3 gms/min. through a long capillary leading to a 0.004 inch (0.1015 mm) spinneret located along the center line of a spin-cell similar to FIG. 4. Hot air (80°C.) flowing at a rate of 44.0 standard liters per minute entered the spin cell at location (8) in FIG. 4 and exited a 0.062 inch (1.574 mm) throat diameter sonic air jet nozzle (12) at the bottom of the spin-cell after flowing around the spinneret. Water at room temperature (15° C.) flowing at a slow rate from jet (35) impinged on the outer surface of the air-jet nozzle, trickled down the slope to the tip of the air-jet nozzle and was atomized by the high velocity air carrying the stream from the spin-cell. The exudate was broken into short pieces and coagulated. The pulp-like product was prepared at a rate of 1.0 g/min. Average fiber length was 5.8 mm ±3.6 mm. The specific surface area was 0.329 m$^2$/gm.

EXAMPLE 4

A short fiber (PPD-T) sliver or roving was prepared at a rate of 68 gms/hour by spinning an anisotropic solution of poly(p-phenyleneterephthalamide) in concentrated sulfuric acid, through 0.062 inch (1.57 mm) throat diameter sonic air jet nozzle in a two stage spinning cell. A diagram of this type of spinning cell is shown in FIG. 5.

A 19.0% solution of poly(p-phenylenetere phthalamide) in concentrated sulfuric acid (100.3%) was fed at a rate of 6gms. per minute through a long capillary leading to the 0.010 inch (0.254 mm) spinneret located along the center line of the spin cell. Hot air (80° C) flowing at a rate of 46 liters per minute entered the first stage of the spin-cell at location (51) passed around the spinneret and left the spin-cell at a temperature of 75° C. at location (53). The first stage of the spin-cell was sealed from the second stage by using a "Teflon" "0" ring at location (54). Air (27° C.) flowing at a rate of 65 liters/min. entered the second stage of the spin-cell at location (52) and at a second location (not shown) which were 180 degrees apart and flowed through an air jet nozzle at location (55). A slow stream of atomized water was sprayed over the stream exiting the spin cell and fibers carried by the air were intercepted by a screen conveyer belt running at a speed of 0.15 meters/-min. to produce a short fiber sliver or roving. The fibers in the roving were further coagulated by a spray of water on the screen conveyor belt. The roving was neutralized by a solution of aqueous sodium hydroxide (0.6%), and washed with water continuously on line.

The average tenacity of the fibers was 9.2 g/denier with a variation between 4 and 14 g/denier and the average fiber denier was 0.43 dpf with a variation between 0.2 and 0.6 dpf.

EXAMPLE 5

A 19.0% solids solution in concentrated sulfuric acid of a 70/30 wt. % mixture of poly(p-phenyleneterephthalamide) and an amorphous nylon comprising a polyamide prepared from a 30/70 mol % mixture of terephthalic and isophthalic acids and a 4/96 mol % mixture of bis(p-aminocyclohexyl)methane and hexamethylene diamine was spun at a solution flow rate of 1.0 gms/min. using a spin-cell similar to that shown in FIG. 1. It had a bullet shaped spinneret with three 0.003 inch (0.0762 mm) diameter holes and a sonic air-jet nozzle with a 0.060 (1.524 mm) inch diameter throat. Pressurized air at 80 to 85° C. was used as attenuating fluid and room temperature water was employed as the coagulating fluid. The distance between the coagulation point and the tip of the air-jet nozzle was about 0.75 inch (1.905 cm).

The fibers had varied cross sections ranging from substantially cylindrical to multilateral ribbons. Fiber length varied between 1.0 and 15.0 mm with an average length of 6.3 mm. The specific surface area of the fibers was 14.856 $m^2/g$.

EXAMPLE 6

A 19.0% solution of a 70/30 wt. % mixture of PPD-T and nylon 6/6 in concentrated sulfuric acid was spun using a spin-cell similar to that shown in FIG. 4, having a bullet shaped spinneret with a single 0.004 inch (0.1016 cm) diameter hole and a sonic air-jet nozzle with 0.06 inch (1.57 mm) diameter at the throat. Air at a temperature between 80 and 85° C. and a pressure of 54.7 psia (3.85 kg/sq.cm.) was used as attenuating fluid and water at room temperature (15° C.) as coagulating fluid. The coagulation was initiated at the tip of the air-jet nozzle. The same experiment was also conducted with a 0.010 inch (0.254 mm) diameter spinneret with similar air flow conditions.

EXAMPLE 7

A 19.0% solution of a 70/30 wt. % mixture of PPD-T and a copolymer prepared from 3,4'-diaminodiphenyl phenyl ether, and isophthaloyl bis(caprolactam) in equal mole percent as described in U.S. Appln. No. 07/257/548 to Singh, in concentrated sulfuric acid was spun using a spin-cell similar to that employed in Example 6. Air at a temperature between 80 and 85° C. and and a pressure of 54.7 psia. was used as the attenuating fluid and water at room temperature (15° C.) as coagulating fluid. Coagulation was initiated at the tip of the air jet nozzle.

The fibrous particles produced had widely different cross-sections ranging from nearly cylindrical to multilateral ribbon-like shapes. The average diameter of the fibers, calculated from specific surface area measurements was 4.5 micron and the fiber length varied between 1.0 and 5.0 nm for an average of 3.0 mm. The specific surface area of the fibers was 0.614$m^2/g$.

EXAMPLE 8

A 15.2% solution of chitosan acetate in a mixture of methylene chloride and trichloracetic acid (60/40 by weight) was spun using a 0.004 inch (0.101 mm) diameter spinneret and 0.062 inch (1.57 mm) throat diameter air jet nozzle. Air (25° C.) was supplied at pressures between 24.7 and 44.7 psia (1.737 and 3.14 kg/sq/cm absolute). The best fibers were obtained at 34.7 psia (2.44 kg/sq.cm) with a polymer solution pressure of 614.7 psia (43.22 kg/sq.cm.) The were initially coagulated at the outer side of the air-jet nozzle throat and allowed to fall in a tray of cold water. They were taken out of the cold water and soaked in methanol overnight.

The discontinuous fibers ranged between 1.0 cm to about 30 cm. Fiber diameters as measured under a microscope. They varied between 0.9 and 1.8 microns. The specific surface area of the fiber was 0.394 $m^2/g$.

We claim:

1. A process for preparing subdenier fiber from lyotropic liquid crystalline polymers comprising (1) extruding a stream of an optically anisotropic solution of a polymer through a spinneret orifice into a chamber, (2) introducing a pressurized gas into said chamber, (3) directing the gas in the flow direction of and in surrounding contact with said stream within the chamber, (4) passing both the gas and stream through an aperture into a zone of lower pressure at a velocity sufficient to attenuate the stream and fragment it into fibers, and (5) contacting the fragmented stream in said zone with a coagulating fluid.

2. A process according to claim 1 wherein the optically anisotropic polymer solution is a solution of poly(p-phenyleneterephthalamide) in concentrated sulfuric acid.

3. A process according to claim 1 wherein the polymer in solution is cellulose triacetate.

4. A process according to claim 1 wherein the polymer in solution is chitosan acetate.

5. A process according to claim 1 wherein the polymer in solution is a mixture of poly(p-phenyleneterephthalamide) and nylon 6/6.

6. A process according to claim 1 wherein the polymer in solution is a mixture of poly(p-phenyleneterephthalamide) and an amorphous polyamide from a mixture of terephthalic and isophthalic acids, bis(p-aminocyclohexyl)methane and hexamethylene diamine.

7. A process according to claim 1 wherein the polymer in solution is a mixture of poly(p-phenylene terephthalamide) and a copolymer prepared from 3,4'-diaminodiphenyl ether and isophthaloyl bis(caprolactam).

8. A process according to claim 1 wherein the zone of lower pressure is air at atmospheric pressure.

9. A process according to claim 1 wherein the gas in contact with the extrudate in the chamber is air.

10. A process according to claim 1 wherein the subdenier fiber is collected in the form of fibers, rovings or nonwoven mats.

11. A process according to claim 2 wherein the coagulating fluid is water.

* * * * *